US006799331B2

(12) United States Patent
Griesbach, III et al.

(10) Patent No.: US 6,799,331 B2
(45) Date of Patent: Oct. 5, 2004

(54) SURGICAL GOWN WITH LIMITED DISCRETE SECTIONS OF ELASTOMERIC MATERIALS

(75) Inventors: Henry L. Griesbach, III, Clarkston, GA (US); Linda Harris, Lawrenceville, GA (US)

(73) Assignee: Kimberly-Clark Worldwide, Inc., Neean, WI (US)

( * ) Notice: Subject to any disclaimer, the term of this patent is extended or adjusted under 35 U.S.C. 154(b) by 0 days.

(21) Appl. No.: 10/286,388

(22) Filed: Nov. 1, 2002

(65) Prior Publication Data

US 2003/0221237 A1 Dec. 4, 2003

(51) Int. Cl.[7] ..... A41B 9/00
(52) U.S. Cl. ..... 2/69; 2/92
(58) Field of Search ..... 2/69, 2, 114, 901, 2/87, 83, 51, 82, 102, 106, 115, 116; 602/58, 59; 604/304, 378, 381, 382

(56) References Cited

U.S. PATENT DOCUMENTS

| | | | | |
|---|---|---|---|---|
| 3,086,214 A | | 4/1963 | Lash | |
| 3,654,632 A | | 4/1972 | Lacroix | |
| 3,720,957 A | * | 3/1973 | Patience | 2/114 |
| 3,759,510 A | * | 9/1973 | Jackson, Jr. | 482/105 |
| 4,525,407 A | | 6/1985 | Ness | |
| 4,670,913 A | | 6/1987 | Morell et al. | |
| 4,698,849 A | | 10/1987 | Mitchell et al. | |
| 5,097,534 A | | 3/1992 | Viemeister et al. | |
| 5,383,235 A | * | 1/1995 | Peters | 2/115 |
| 5,461,724 A | | 10/1995 | Wiedner et al. | |
| 5,492,753 A | | 2/1996 | Levy et al. | |
| 5,582,903 A | | 12/1996 | Levy et al. | |
| 5,694,645 A | * | 12/1997 | Triplette | 2/102 |
| 5,695,849 A | | 12/1997 | Shawver et al. | |
| 5,724,674 A | | 3/1998 | Covington et al. | |
| 5,794,276 A | | 8/1998 | Walker | |
| 5,883,028 A | | 3/1999 | Morman et al. | |
| 6,028,240 A | | 2/2000 | Wessel et al. | |
| 6,052,826 A | | 4/2000 | Tolton | |
| 6,076,187 A | * | 6/2000 | Wallerstein | 2/115 |
| 6,115,839 A | | 9/2000 | Covington et al. | |

FOREIGN PATENT DOCUMENTS

| | | |
|---|---|---|
| EP | 1163858 | 12/2001 |
| WO | 0103528 | 1/2001 |

OTHER PUBLICATIONS

US patent application Publication, US 2002/0138893, Garments with Stretch Fabrics, Oct. 3, 2002.*
PCT Search Report.

* cited by examiner

*Primary Examiner*—Gary L. Welch
(74) *Attorney, Agent, or Firm*—Dority & Manning, P.A.

(57) ABSTRACT

A protective garment, such as a surgical gown, includes areas subjected to tensile stretching forces when worn by a wearer. Such areas may correspond to back shoulder regions of the garment. Elastomeric patches are provided in at least one of the identified areas subjected to the tensile stretching forces, the elastomeric patches being generally surrounded by the remaining garment material.

23 Claims, 5 Drawing Sheets

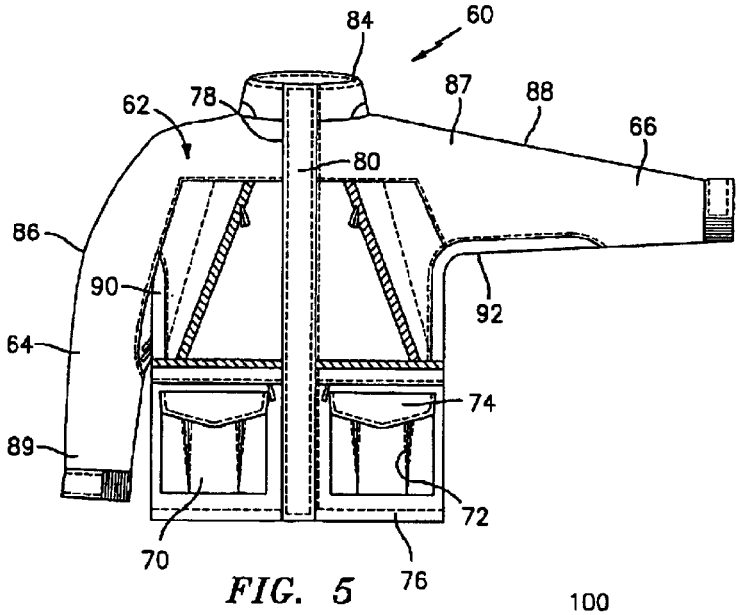
FIG. 5
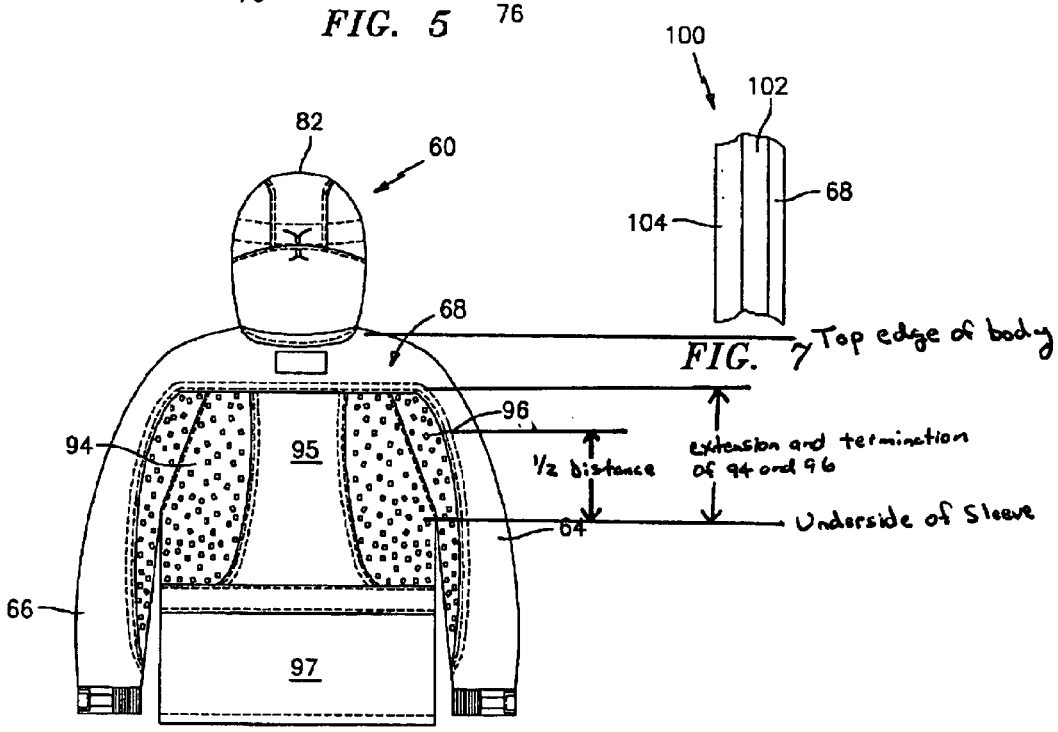
FIG. 7
FIG. 6

SURGICAL GOWN WITH LIMITED DISCRETE SECTIONS OF ELASTOMERIC MATERIALS

TECHNICAL FIELD OF THE INVENTION

The present invention relates generally to the field of protective garments, and more particularly to an improved surgical gown configuration.

BACKGROUND

Protective garments such as surgical gowns are well known. The usefulness of these garments is generally influenced by a number of factors, such as breathability, resistance to fluid flow, barrier protection qualities, etc. Comfort of the garment is also an important factor. For example, a surgical gown must be comfortable to a person wearing the garment for extended hours.

Factors affecting the comfort of the garment include the stretch properties, softness, and breathability of the garment material. Materials that are soft, stretchable, and breathable are typically more comfortable than materials that do not have those characteristics.

Conventional disposable surgical gowns are commonly constructed from a nonwoven fabric. The gown body section is generally a singular piece of material, or is composed of a number of panels of material attached together, for example, a front panel and attached sidepanels that also define a back section of the gown. Sleeves are attached to the gown body by any number of known techniques. An example of a surgical gown made using raglan-type sleeves attached to a one piece gown body is the Lightweight Gown (product code 90751) from Kimberly-Clark, Corp. of Neenah, Wis., USA. When a gown of this type is donned and the wearer's arms are extended outward in front of the torso and crossed, the fabric in the back shoulder area is tensioned and felt as a restrictive force against the wearer's shoulders. This restrictive force is most often identified by wearers in the area where the gown body fabric joins the back and underside of the sleeves.

A common method to attempt to reduce (relieve) restrictive forces is to incorporate more fabric in the areas placed under tension, such as via pleats, or inserted secondary patches. Another approach suggested in the art is to construct the gown body out of an elastomeric or recoverable-stretch material so that when the fabric is subjected to the restrictive forces (the forces encountered by a non-elastomeric fabric), the fabric elongates. Various elastomeric nonwoven materials and fabrics are available for such purpose, including laminates of a nonwoven web and elastomeric film.

A drawback of making the entire gown body, or entire panel portions, of an elastomeric material is that such materials are significantly more costly, and thus add to the overall cost of the product and healthcare in general. The present invention relates to a unique configuration for a protective garment, particularly a surgical gown, that has the benefits of elastomeric materials without the significant cost associated with conventional elastomeric material gowns.

SUMMARY

Objects and advantages of the invention will be set forth in the following description, or may be obvious from the description, or may be learned through practice of the invention.

The present invention relates to a unique configuration for a protective garment, particularly a surgical gown, wherein patches of extensible material are selectively provided in the gown in the areas of maximum stress (i.e., the areas subjected to a maximum stretching force when worn by a wearer). The extensible patch areas are completely surrounded by the remaining material of the gown (generally a non-extensible material) and, thus, may be thought of "islands" of extensible material strategically located in the gown. For certain ranges of motion, the areas of maximum stress, or areas subjected to maximum tensile stretching force when worn by a wearer, are in the back shoulder portions of the gown and extend from an area from just below the underside of the sleeves to a point between the underside of the sleeves and the top edge of the gown body. Thus, in one embodiment, it is these areas that extensible material patches are disposed. In the embodiment wherein the back portion of the gown is open and defined by back panel sections, an extensible material panel is provided in each of the back shoulder portions of each panel.

The extensible material patches are not limited to any particular shape. In one particular embodiment, the patches are crescent shaped and generally follow the contour of the sleeve openings in the gown body. In another embodiment, the extensible material patches are generally elongated members having a longitudinal dimension greater than a lateral dimension.

It should be appreciated that a garment, in particular a surgical gown, constructed in accordance with the invention is not limited to any particular type of materials. Conventional materials for forming the body and sleeves of a gown are well known to those skilled in the art, and any such material may be used for a gown in accordance with the present invention. Likewise, there are a number of elastomeric extensible materials used in the art that may serve adequately as the extensible material patches for use in the present invention. Examples of such materials will be described in greater detail below.

The garment according to the invention may have a conventional body configuration. For example, the garment may have a closed front portion that is made from a first panel of material and an open back portion defined by back panels that are attached to the first panel of material alongside the seams of the garment. In an alternate embodiment, the garment may have front and back portions formed from a single piece of material. The style and configuration of the garments is not a limiting factor. Regardless of the type of garment, extensible material patches may be incorporated into the gown at areas subjected to tensile stretching forces.

The invention will be described in greater detail below by reference to embodiments illustrated in the figures.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION

Figure 1:
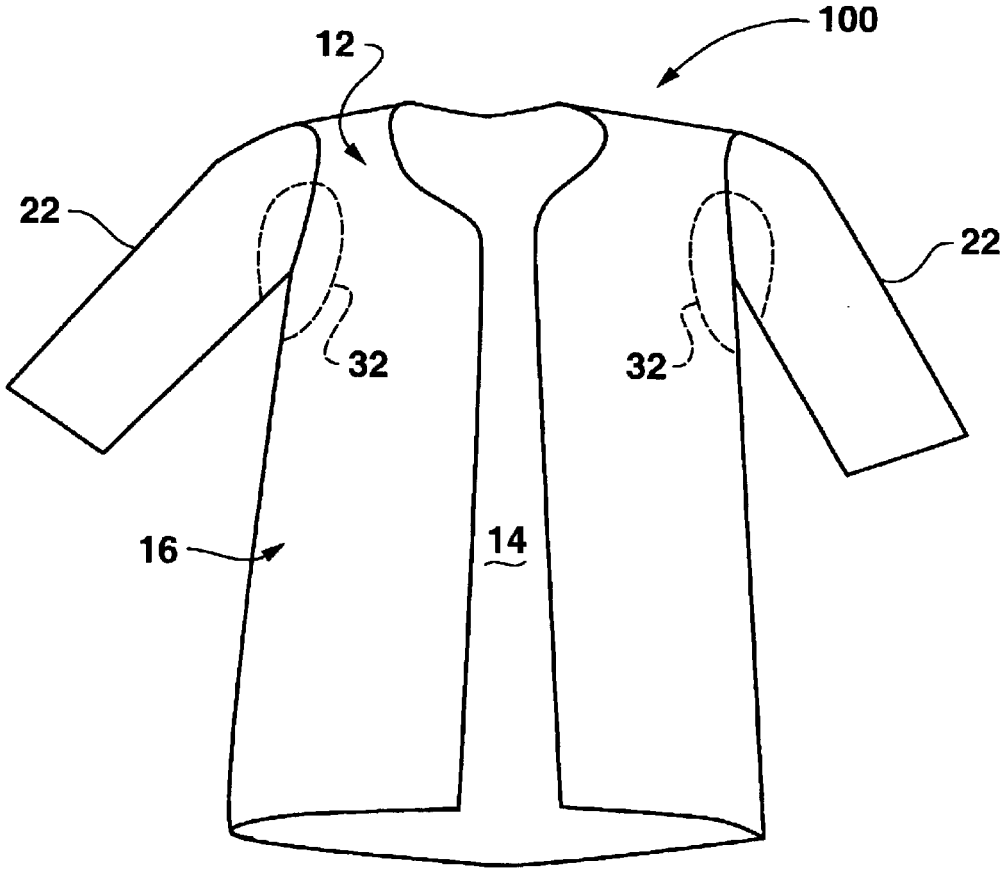
FIG. 1 Prior Art
FIG. 1 is a perspective view of a prior art surgical gown.

Reference will now be made in detail to one or more embodiments of the invention, examples of which are graphically illustrated in the drawings. Each example and embodiment are provided by way of explanation of the invention, and not meant as a limitation of the invention. For example, features illustrated or described as part of one embodiment may be utilized with another embodiment to yield still a further embodiment. It is intended that the present invention include these and other modifications and variations.

"Attached" refers to the bonding, joining, adhering, connecting, attaching, or the like, of two elements. Two elements may be considered attached together when they are bonded directly to one another or indirectly to one another, such as when each is directly attached to an intermediate element.

"Elastomeric" refers to a material or composite which can be extended or elongated by at least 25% of its relaxed length and which will recover, upon release of the applied force, at least 10% of its elongation. It is generally preferred that the elastomeric material or composite be capable of being elongated by at least 100%, recover at least 50% of its elongation. An elastomeric material is thus stretchable and "stretchable", "elastomeric", and "extensible" may be used interchangeably.

"Elastic" or "Elasticized" means that property of a material or composite by virtue of which it tends to recover towards its original size and shape after removal of a force causing a deformation.

"Neck-bonded" laminate refers to a composite material having an elastic member that is bonded to a non-elastic member while the non-elastomeric member is extended in the machine direction creating a necked material that is elastic in the transverse or cross-direction. Examples of neck-bonded laminates are disclosed in U.S. Pat. Nos. 4,965,122; 4,981,747; 5,226,992; and 5,336,545, which are incorporated herein by reference in their entirety for all purposes.

"Stretch-bonded" laminate refers to a composite material having at least two layers in which one layer is a gatherable layer and the other layer is an elastic layer. The layers are joined together when the elastic layer is in an extended condition so that upon relaxing the layers, the gatherable layer is gathered. For example, one elastic member can be bonded to another member while the elastic member is extended at least about 25% of its relaxed length. Such a multiplayer composite elastic material may be stretched until the non-elastic layer is fully extended. Examples of stretch-bonded laminates are disclosed, for example, in U.S. Pat. Nos. 4,720,415,4,789,699, 4781,966, 4,657,802, and 4,655,760, which are incorporated herein by reference in their entirety for all purposes.

As used herein, the term "nonwoven web" refers to a web that has a structure of individual fibers or filaments which are interlaid, but not in an identifiable repeating manner. Nonwoven webs have been, in the past, formed by a variety of processes known to those skilled in the art such as, for example, meltblowing and melt spinning processes, spunbonding processes and bonded carded web processes.

As used herein, the term "spunbonded web" refers to web of small diameter fibers and/or filaments which are formed by extruding a molten thermoplastic material as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent No. 803,714.

As used herein, the term "meltblown web" refers to a nonwoven web formed by extruding a molten thermoplastic material through a plurality of fine, usually circular, die capillaries as molten fibers into converging high velocity gas (e.g. air) streams that attenuate the fibers of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin, et al., which is incorporated herein in its entirety by reference thereto for all purposes. Generally speaking, meltblown fibers may be microfibers that may be continuous or discontinuous, are generally smaller than 10 microns in diameter, and are generally tacky when deposited onto a collecting surface.

As used herein, the term "disposable" is not limited to single use or limited use articles but also refers to articles that are so inexpensive to the consumer that they can be discarded if they become soiled or otherwise unusable after only one or a few uses.

As used herein, the term "garment" refers to protective garments and/or shields including for example, but not limited to, surgical gowns, patient drapes, work suits, aprons and the like.

As used herein, the term "liquid resistant" or "liquid repellant" refers to material having a hydrostatic head of at least about 25 centimeters as determined in accordance with the standard hydrostatic pressure test AATCCTM No. 127-1977 with the following exceptions: (1) The samples are larger than usual and are mounted in a stretching frame that clamps onto the cross-machine direction ends of the sample, such that the samples may be tested under a variety of stretch conditions (e.g., 10%, 20%, 30%, 40% stretch); and (2) The samples are supported underneath by a wire mesh to prevent the sample from sagging under the weight of the column of water.

As used herein, the term "breathable" means pervious to water vapor and gases. For instance, "breathable barriers" and "breathable films" allow water vapor to pass therethrough, but are liquid resistant. The "breathability" of a material is measured in terms of water vapor transmission rate (WVTR), with higher values representing a more breathable material and lower values representing a less breathable material. Breathable materials generally have a WVTR of greater than about 250 grams per square meter per 24 hours ($g/m^2/24$ hours). In some embodiments, the WVTR may be greater than about 1000 $g/m^2/24$ hours. Further, in some embodiments, the WVTR may be greater than about 3000 $g/m^2/24$ hours. In some embodiments, the WVTR may be greater than about 5000 $g/m^2/24$ hours.

As used herein, the term "reversibly-necked material" refers to a necked material that has been treated while necked to impart memory to the material so that when force is applied to extend the material to its pre-necked dimensions, the necked and treated portions will generally recover to their necked dimensions upon termination of the force. A reversibly-necked material may include more than one layer. For example, multiple layers of spunbonded web, multiple layers of meltblown web, multiple layers of bonded carded web or any other suitable combination of mixtures thereof. The production of reversibly-necked materials is illustrated in patents such as, for example, Mormon, U.S. Pat. Nos. 4,965,122 and 4,981,747.

The present invention relates to a unique configuration for a protective garment. The garment is illustrated and described herein as a surgical gown for illustrative purposes. It should be appreciated though that a garment in accordance with the invention is not limited to a gown, and may include, for example, a patient gown or drape, work coverall, robe, etc. A conventional gown 100 is conceptually illustrated in FIG. 1. The gown includes a gown body 12 having a front portion 14 and a back portion 16. The gown body may be formed from a single piece of material, or may be defined by separate panels of material joined at seams. Sleeves 22 are generally attached to the gown body at sleeve openings defined in the body 12. The sleeves 22 may be of the same or a different material as the body 12. Various configurations of gowns 100 are well known to those skilled in the art and all such configurations are within the scope and spirit of the invention.

The gown material is generally a breathable yet liquid resistant barrier material. The breathability of the material increases the comfort of someone wearing such a garment, especially if the garment is worn under high heat index conditions, vigorous physical activity, or long periods of time. Various suitable woven and non-woven barrier materials are known and used in the art for garments such as surgical gowns, and all such materials are within the scope of the present invention. A suitable gown material is, for example, a Spunbond-Meltblown-Spunbond laminate as described in U.S. Pat. No. 5,464,688, incorporated herein by reference for all purposes, with appropriate chemical treatments to enhance liquid repellency and static decay.

Still referring to FIG. 1, it has been determined that the areas of greatest restrictive force generated when the gown 100 is donned and the wearer's arms are extended outwardly are the back shoulder areas adjacent to the sleeves. The restrictive forces felt by the wearer are generated by tensile stretching forces exerted on the material. The restrictive force areas are designated generally by the dashed-line areas 32 in FIG. 1. The present applicants have found that the restrictive forces can be greatly alleviated by first identifying the precise areas wherein the tensile stretching force is generated, and then replacing the non-elastomeric gown material in these areas with isolated zones or patches of elastomeric material. By precisely mapping the stressed areas, the amount of elastomeric material used in the gown is minimized and a more comfortable gown can be made with little additional cost. Embodiments of garments, e.g., gowns, according to the invention are described in greater detail below with reference to FIGS. 2–4.

Figure 2A:
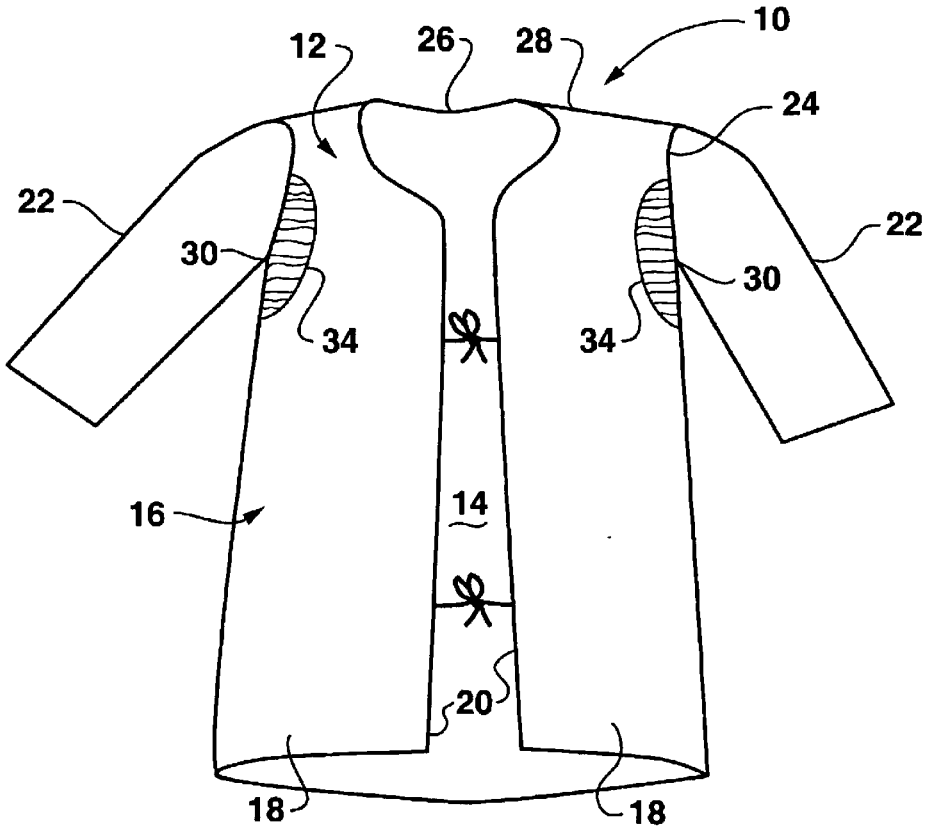
FIG. 2A is a perspective view of a garment in accordance with the present invention.
Figure 3A:
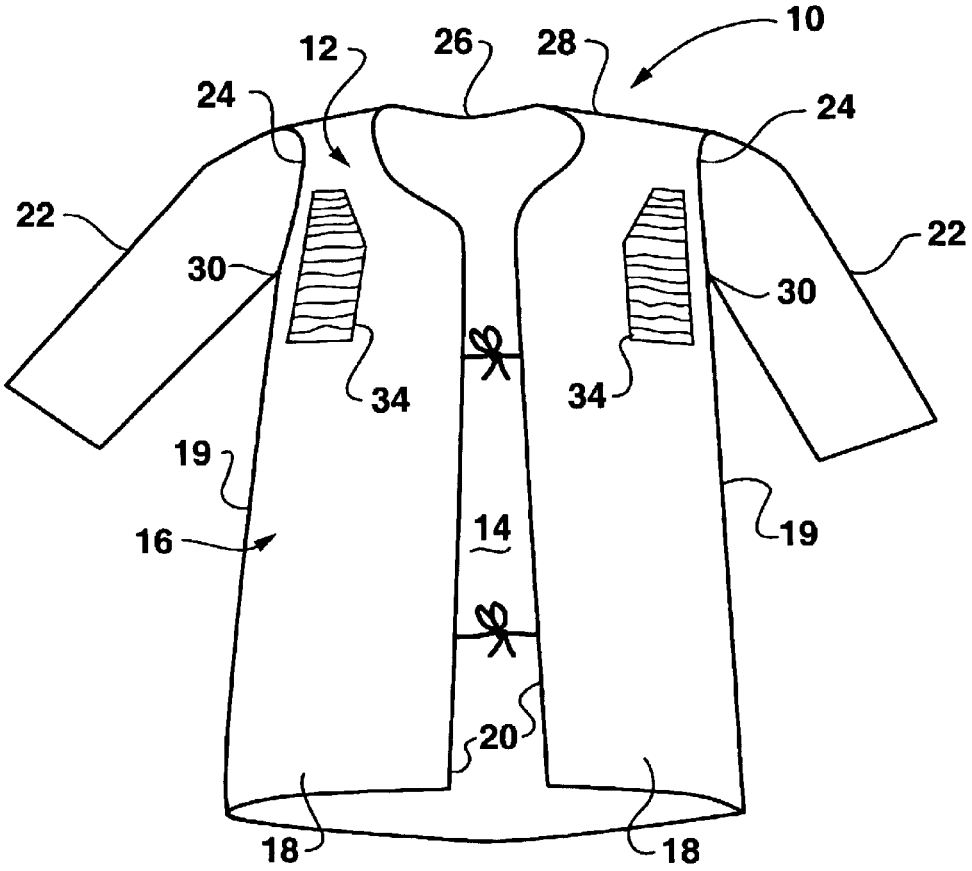
FIG. 3A is a perspective view of a garment in accordance with the present invention.

FIG. 2A illustrates a gown 10 in accordance with the invention. The gown 10 is similar in many aspects to the conventional gown illustrated in FIG. 1. The gown 10 includes a gown body 12 having a front 14 and a back 16. The back 16 may be an open back defined by adjacent back portions 18 having opposite longitudinal edges 20. The back portions 18 include back shoulder regions, back waist regions, lower regions, etc. Any type of known fastening means, such as conventional ties, may be used for securing the gown 10 on a wearer. The gown body 12 may be formed from a single piece of material, such as a breathable yet liquid resistant barrier material, defining a neck opening 26 and sleeve openings 24. Sleeves 22 are attached to the gown body 12 at the sleeve openings 24 by any conventional attaching means. In an alternate embodiment, the gown body 12 may be formed from separate panels of the same or different materials that are attached or adhered along seams. For example, the back portions 18 may be panels of material adhered to a front panel of material defining the front portion 14 along sides seams 19 (FIG. 3A).

Figure 2B:
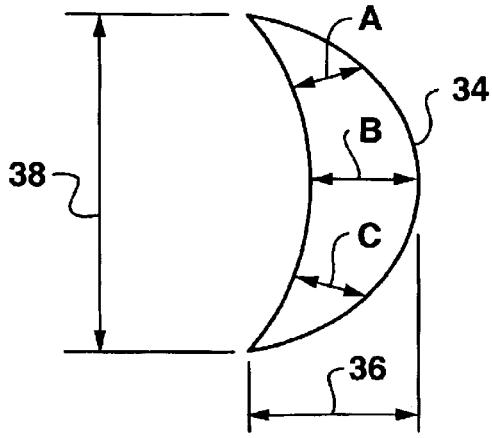
FIG. 2B is an enlarged planar view of the elastomeric panel used in the garment of FIG. 2A.

Patches of elastomeric material 34 are formed into areas 32 of the gown body 12 generating the greatest restrictive forces. The location of such areas is not limiting and may vary depending on the overall style, configuration, and size of the gown 10. A method for precisely defining such areas 32 is described in greater detail below. In the illustrated embodiment, the areas 32 are located in the back shoulder portions of the gown body 12. The geometric shape of the elastomeric patches 34 may vary depending on the size and shape of the areas 32 of the gown body 12 generating the restrictive forces. By precisely mapping the restrictive force areas 32, a more precise shape of the patches 34 is possible. In FIGS. 2A and 2B, the patches 34 are generally crescent shaped and follow the contour of the sleeve openings 24. The crescent shapes extend laterally between the sleeve openings 24 and longitudinal edges 20 of the back panels 18. As can be seen in the figures, the patches 34 are generally completely surrounded by the gown body material, which may be non-elastomeric or less elastomeric then the patches 34. In this regard, the patches may be thought of as "islands" of elastomeric material corresponding to the location of the restrictive force areas 32.

Figure 3B:
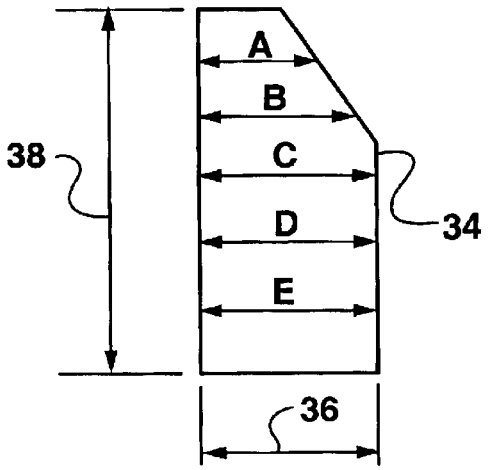
FIG. 3B is an enlarged planar view of the elastomeric panel used in the garment of FIG. 3A.

For the back shoulder regions of a gown 10, it has been found that the patches 34 may have various shapes and extend laterally along the back portions between sleeve openings or seams 24 and the longitudinal edges 20 of the backportions 18, and extend longitudinally from a point below an underside 30 of the sleeves 22 to point between the underside 30 and a top edge 28 of the gown body 12. Referring to FIGS. 2B, 3B, and 4B, the longitudinal dimension 38 of the patches 34 may be greater than the lateral dimension 36. In one embodiment, the patches 34 may extend at least about one-third of the length between the underside 30 of the sleeves 22 and the top edge 28 of the gown body 12. For example, the patches 34 may extend about one-half of the length between the underside 30 of the sleeves and top edge 28 of the gown body.

The elastomeric patches 34 are stretchable in the general directions of the tensile forces exerted on the areas 32. For example, if the patches 34 are located in the back shoulder regions as illustrated in the figures, the patches 34 are stretchable at least in the lateral direction across the back of a wearer. The arrow lines in FIGS. 2B, 3B, and 4B conceptually illustrate the general stretch directions of the patches 34 located in the back shoulder regions of the respective gowns in FIGS. 2A, 3A, and 4A. In an embodiment wherein the areas 32 are subjected to longitudinal stretching forces (for example, at the back waist region when the wearer bends over), the patches 34 may be stretchable at least in the longitudinal direction. It may be desired that the patches 34 be elastomeric in generally all directions to maximize benefit of the patches.

The patches 34 are formed into the gown material by any suitable method. For example, the patches may be sonically or ultrasonically welded to the gown material. The patches 34 may be stitched, taped, or adhered to the gown material. The patches 34 may be thermally bonded to the gown material. Any one of a number of known conventional attaching methods may be used for this purpose.

Various elastomeric materials are known in the art that may be used for the patches 34. The patches 34 may, for example, be composed of a single layer, multiple layers, laminates, spunbond fabrics, films, meltblown fabrics, elastic netting, microporous web, bonded carded webs or foams comprised of elastomeric or polymeric materials. Elastomeric nonwoven laminate webs may include a nonwoven material joined to one or more gatherable nonwoven webs, films, or foams. Stretch-bonded laminates (SBL) and Neck-bonded laminates (NBL) are examples of elastomeric nonwoven laminate webs. Nonwoven fabrics are any web of material which has been formed without the use of textile weaving processes which produce a structure of individual fibers which are interwoven in an identifiable repeating manner. Examples of suitable materials are Spunbond-Meltblown fabrics, Spunbond-Meltblown-Spunbond fabrics, Spunbond fabrics, or laminates of such fabrics with films, foams, or other nonwoven webs. Elastomeric materials may include cast or blown films, foams, or meltblown fabrics composed of polyethylene, polypropylene, or polyolefin copolymers, as well as combinations thereof. The elastomeric materials may include polyether block amides such as PEBAX® elastomer (available from AtoChem located in Philadelphia, Pa.), thermoplastic polyurethanes (e.g., both aliphatic-polyether and aliphatic-polyester types), HYTREL® elastomeric copolyester (available from E. I. DuPont de Nemours located in Wilmington, Del.), KRATON® elastomer (available from Shell Chemical Company located in Houston, Tex.), or strands of LYCRA® elastomer (available from E. I. DuPont de Nemous located in Wilmington, Del.), or the like, as well as combinations thereof. The patches 34 may include materials that have elastomeric properties through a mechanical process, printing process, heating process, or chemical treatment. For examples such materials may be apertured, creped, neck-stretched, heat activated, embossed, and micro-strained; and may be in the form of films, webs, and laminates.

In one particular embodiment, the elastomeric patches 34 are a neck-bonded laminate of a necked non-woven web of spunbond polypropylene laminated to an elastic film, for example a 6.8 gsm PEBAX film with 16% (by weight) of pigment grade titanium dioxide particles.

FIG. 3A is a perspective view of an alternate embodiment of a gown 10 according to the invention. The gown 10 is similar to the gown described above with respect to FIG. 2A with the exception of the elastomeric patches 34. In this embodiment, the patches 34 have an overall elongated trapezoidal profile with a straight edge that wherein is generally parallel to the sleeve seam 24. This edge extends slightly below the underside 30 of the sleeve 22 and extends in the opposite direction generally to adjacent the top edge 28 of the gown. However, as described in greater below, the upper portion of the patches 34 may extend beyond areas of the gown body subjected to tensile stressing forces and, thus, may not be necessary.

It may be found that the elastomeric patches 34 do not need to extend generally beyond one-half of the distance or length between the underside 30 of the sleeve 22 and the top edge 28 of the gown body. The elastomeric panel 34 is shown in an enlarged view in FIG. 3B. As can be seen from this figure, the panel 34 has a longitudinal dimension 38 that is significantly greater than the lateral dimension 36.

As mentioned, it may be desirable to precisely map out the areas 32 subjected to tensile stressing forces in order to define an accurate shape and location for the elastomeric patches 34. The applicants have found that an accurate method for mapping these areas 32 is to place oversized elastomeric patches in the regions of the gown generally noted by individuals as applying restrictive forces in normal use of the gowns. For example, users typically note that a noticeable restrictive force is placed across the back upper shoulder regions of the gown, particularly when the users extend their arms forward. Other restrictive forces may be felt, for example, in the waist regions when the user bends forward or leans sideways, etc. Once suspected or generalized areas have been identified, an oversized area of the gown corresponding to such locations may be removed from the gown (i.e. cut out of the gown). Pieces of the elastomeric material may then be attached to the gown superimposed over the cut out areas. A grid is then defined on the pieces of elastomeric material. The grid may be, for example, a block pattern, line pattern, etc. The grid essentially provides an array of distinct marks or lines that will change relative position upon the elastomeric material being stretched. The change in relative position is measured and the areas of maximum relative change between the grid marks correspond to the areas of greatest tensile stress and thus the areas of greatest restrictive force felt by the wearer. The areas of least relative change between the grid marks correspond to the areas of least tensile stress. Areas wherein the grid marks essentially do not change correspond to areas of the gown that are not generally susceptible to tensile stress, and thus to areas that will not benefit by substitution of elastomeric material.

For example, referring to FIGS. 2*a* and 2*b*, the crescent shape patches 34 were first attached to the gown in the position shown in Fig. 2A, and then the gown material occluded by the patches 34 was removed. A grid of three arrays of spaced apart lines was marked onto the patches 34 in the locations indicated by the arrows A, B, and C in FIG. 2B. The lines were relatively small vertical lines spaced about one centimeter apart. The arrays of lines thus resembled the markings on a conventional measuring tape. The first array A was defined approximately 20 centimeters from the top edge 28 of the gown body 12. The second array B was defined approximately 25 centimeters from the top edge 28, and the third array C was defined approximately 34 centimeters from the top edge 28 and slightly angled with respect to the other arrays, as illustrated generally in FIG. 2B. The gown 10 was donned and the wearer instructed to move about so as to generate the tensile stretching forces in the back shoulder regions, for example by extending the arms outward in front of the torso and crossing the arms. Under this condition, the change in the spacing between the lines was measured. The material along the first array B extended or stretched 40 percent (the material had a stretched length of 140 percent of its relaxed length), the elastomeric material along the second array B extended 50 percent, and the elastomeric material along the third array C extended 25 percent. Upon the wearer relaxing the arms, the grid lines along the arrays return to their initial spacing indicating that the restrictive forces were stopped.

It should be appreciated that this grid mapping technique may be utilized to accurately determine the locations of tensile forces generated anywhere on a garment body resulting in restrictive forces against the wearer. The method is empirical by nature and there will obviously be some degree of trial and error. However, by widening the grid areas and measuring different patterns resulting from various movements of a wearer, areas 32 that are subjected to tensile forces may be accurately determined and, if desired, substituted with elastomeric patches 34, as described above.

With respect to the embodiments of FIGS. 3*a* and 3*b*, the length of the elastomeric patches 34 was longitudinally extended towards the top edge 28 of the gown body 12 to determine to what extent tensile forces are generated closer to the top edge 28. Five arrays of grid lines A through E were defined on the elastomeric patches 34 at the positions and direction indicated in FIG. 3B. The elastomeric panel was positioned in the gown body 12 to include the area in the upper back panel adjacent to the sleeve, as well as the area adjacent to the underarm of the sleeve. A border of the original non-elastomeric gown material was retained around the neck and sleeve edges to facilitate positioning and retaining of the elastomeric material. The first array of lines A were defined 16 centimeters from the top edge 28. The second array defined at 22 centimeters from the top edge, the third array C at about 29 centimeters from the top edge, the fourth array D at about 39 centimeters from the top edge, and the fifth array E at about 46 centimeters from the top edge of the gown. The gown was then donned and subjected to the same conditions as described above with respect to the gown of FIG. 2A. Extension in the elastomeric patches 34 was observed via changes in the spacing between the grid lines in the arrays. It was noted that no extension was observed along the grid lines corresponding to grids A and B. The material extended about 25 percent along grid pattern C, and about 50 percent along grid patterns D and E. Thus, it was determined that elastomeric material extending above grid pattern B does not add any significant benefit. It was also noted that the bottom edge of the elastomeric patches in FIGS. 2*a* and 3*a* was located the same distance from the top edge 28 of the gown body. However, with the shape and configuration of the elastomeric patches 34 in FIGS. 3*a* and 3*b*, the elastomeric material extended or stretched 50 percent along the bottom array E as compared to 25 percent along the bottom array C in the crescent shaped panel 34 used in FIGS. 2*a* and 2*b*. It may be that the crescent shape of the panel 34 did not adequately extend into areas subjected to tensile stressing forces. It should thus be apparent that the shape of the elastomeric patches 34 may also play a role in the degree or magnitude of relief provided by the patches.

Figure 4A:
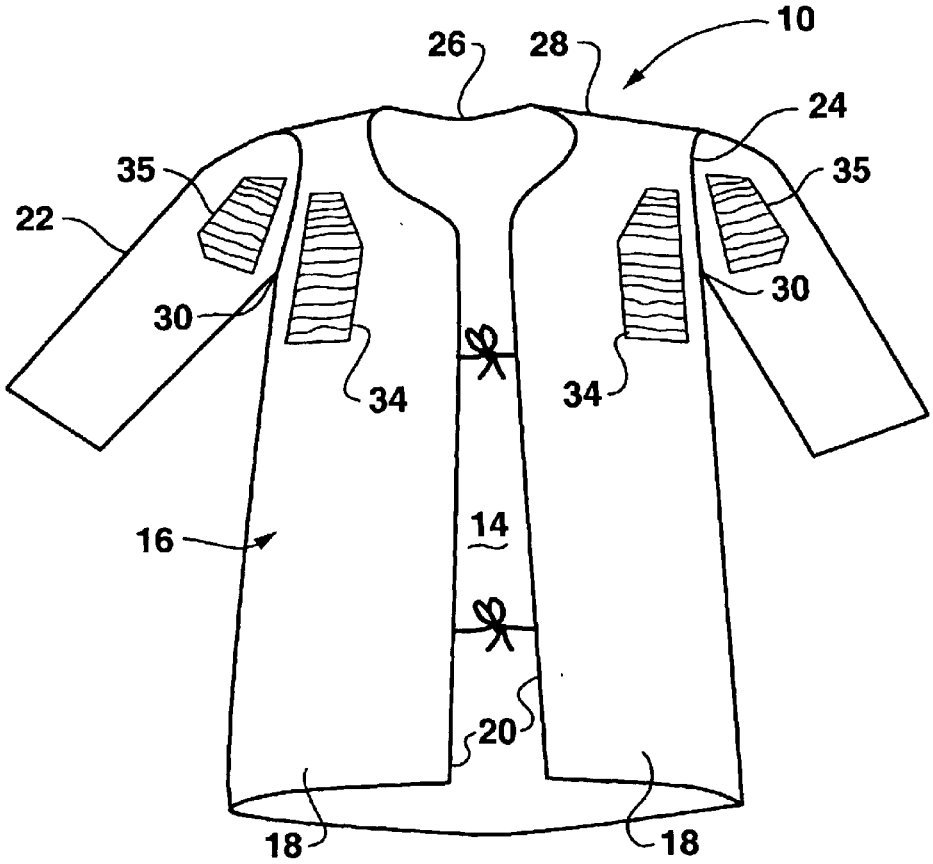
FIG. 4A is a perspective view of a garment in accordance with the present invention.
Figure 4B:
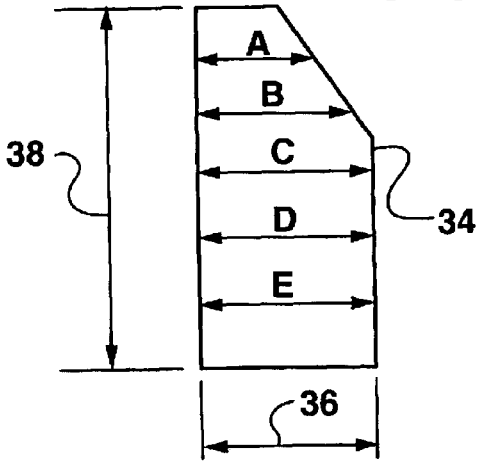
FIGS. 4B and 4C are enlarged planar views of the elastomeric patches used in the garment of FIG. 4A.
Figure 4C:
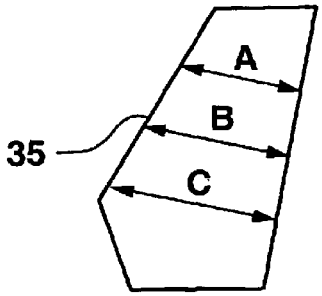

The gown of FIGS. 4*a* and 4*b* is essentially identical to that of FIGS. 3*a* and 3*b* with the exception that an additional elastomeric panel 35 was attached to the upper portion of each sleeve to determine if this area of the gown also contributed to the restrictive forces felt by the wearer. Grid patterns A, B, and C were defined on the panel 35 as indicated in FIG. 4C. The gown was then donned and subjected to the same conditions as described above with respect to the other gowns. It was noted that the grid patterns A, B, and C for the patches 35 indicated no extension or stretch of the materials. Thus, it was accurately determined that this portion of the gown body was not subjected to tensile stretching forces and did not contribute to restrictive forces felt by the wearer.

It should be appreciated by those skilled in the art that the system and method according to the invention have wide applications, and that the example and embodiments set forth herein are merely exemplary. It is intended that the present invention include such uses and embodiments as come within the scope and spirit of the appended claims.

What is claimed is:

1. A protective garment, said garment comprising:

a body having a closed front, and an open back defined by back portions having opposite longitudinal edges, said back portions made from a first generally non-elastomeric material, said front and back portions defining sleeve openings;

sleeves attached to said sleeve openings along a generally continuous sleeve seam, said sleeve seam having a back portion running from a top edge of said body to an underside of said sleeve;

a patch of separate elastomeric material formed into each of said back portions such that said elastomeric patches are completely encircled by said non-elastomeric material; and said elastomeric patches extending laterally along said back portions between said sleeve seam and said longitudinal edge of said back portion, and extending longitudinally from a point below said underside of said sleeve to point above said underside of said sleeve, wherein said elastomeric patches extend and terminate less than or equal to about one-half of the distance from said underside of said sleeve to said top edge of said body.

2. The garment as in claim 1, wherein said elastomeric patches extend and terminate at least about one-third of a distance from said underside of said sleeve to said top edge of said body.

3. The garment as in claim 2, wherein said elastomeric patches extend and terminate at about one-half of the distance from said underside of said sleeve to said top edge of said body.

4. The garment as in claim 1, wherein said elastomeric patches have a longitudinal dimension greater than a lateral dimension thereof.

5. The garment as in claim 4, wherein said elastomeric patches have a generally crescent shape.

6. The garment as in claim 1, wherein said elastomeric patches are stretchable in the lateral direction.

7. The garment as in claim 6, wherein said elastomeric patches are formed of a necked-bonded laminate.

8. The garment as in claim 1, wherein said front and said back portions are formed of a single piece of said first generally non-elastomeric material.

9. The garment as in claim 1, wherein said closed front is made from a first panel of material, and said back portions comprise panels attached to said first panel of material along side seams of said garment.

10. The garment as in claim 1, wherein said garment is a surgical gown.

11. A protective garment, said garment comprising:

a front portion, a back portion, and sleeves;

said back portion further comprising back shoulder regions defining areas of maximum lateral force across said back portion of said garment when worn by an individual; and elastomeric patches provided in said back shoulder regions in areas corresponding to said areas of maximum lateral force, wherein said elastomeric patches extend and terminate less than or equal to about one-half of the distance from an underside of said sleeve to a top edge of said back portion.

12. The protective garment as in claim 11, wherein said back portion is formed of a generally non-elastomeric material, said elastomeric patches surrounded by said non-elastomeric material.

13. The protective garment as in claim 11, wherein said front is a closed portion, and said back portion is an open portion comprising opposite longitudinal edges, and wherein at least one said elastomeric patch is provided in each of said back shoulder regions.

14. The protective garment as in claim 11, wherein said elastomeric patches extend and terminate at least about one-third of a distance from said underside of said sleeve to said top edge of said back portion.

15. The protective garment as in claim 14, wherein said elastomeric patches extend and terminate at about one-half of the distance from said underside of said sleeve to said top edge of said back portion.

16. The protective garment as in claim 11, wherein said elastomeric patches have a longitudinal dimension greater than a lateral dimension thereof.

17. A protective garment, said garment comprising: a body portion, and sleeves attached to said body portion;

said body portion comprising pre-defined areas that are placed under a tensile stretching force when the garment is worn by an individual; and wherein at least one of said pre-defined areas comprises a patch of elastomeric material surrounded by a generally non-elastomeric material, said elastomeric material relieving said stretching force in said area, wherein said patch of elastomeric material extends and terminates less than or equal to about one-half of the distance from an underside of said sleeve to a top edge of said body portion.

18. The protective garment as in claim 17, wherein said pre-defined area comprises a back shoulder region of said body.

19. The protective garment as in claim 18, wherein each back shoulder region of said body comprises said patch of elastomeric material.

20. The protective garment as in claim 19, comprising a separate patch of said elastomeric material in each of said back shoulder regions.

21. The protective garment as in claim 20, wherein said elastomeric material patches extend and terminate at least about one-third of a distance from said underside of said sleeves to said top edge of said body.

22. The protective garment as in claim 21, wherein said elastomeric material patches extend and terminate at about one-half of the distance from said underside of said sleeve to said top edge of said body.

23. The protective garment as in claim 21, wherein said elastomeric material patches have a longitudinal dimension greater than a lateral dimension thereof.

* * * * *

UNITED STATES PATENT AND TRADEMARK OFFICE

CERTIFICATE OF CORRECTION

PATENT NO. : 6,799,331 B2
APPLICATION NO. : 10/286388
DATED : October 5, 2004
INVENTOR(S) : Henry L. Griesbach, III and Linda Harris It is certified that error appears in the above-identified patent and that said Letters Patent is hereby corrected as shown below:

In Drawings
Please remove "Sheet 5 of 5" of the drawings from the issued patent. These figures are not part of the application and appear to have been inadvertently added by the Examiner.

Signed and Sealed this

Seventh Day of July, 2009

John Doll

JOHN DOLL
*Acting Director of the United States Patent and Trademark Office*